US006900954B2

(12) United States Patent
Tichy

(10) Patent No.: US 6,900,954 B2
(45) Date of Patent: May 31, 2005

(54) VIEWING ENHANCED APPARATUS FOR VISIBILITY IMPAIRED FLUID

(76) Inventor: James B. Tichy, P.O. Box 1308, Sausalito, CA (US) 94966

( * ) Notice: Subject to any disclaimer, the term of this patent is extended or adjusted under 35 U.S.C. 154(b) by 56 days.

(21) Appl. No.: 10/623,077

(22) Filed: Jul. 18, 2003

(65) Prior Publication Data

US 2005/0024755 A1 Feb. 3, 2005

Related U.S. Application Data

(60) Provisional application No. 60/399,051, filed on Jul. 26, 2002.

(51) Int. Cl.[7] ..... G02B 27/00; G02B 5/00; G02B 7/00

(52) U.S. Cl. ..... 359/895; 396/28; 348/81; 441/135; 128/201.27; 405/186

(58) Field of Search ..... 359/894, 895; 396/25, 28; 348/81; 441/135; 114/66; 128/201.27, 201.29; 405/186

(56) References Cited

U.S. PATENT DOCUMENTS

| | | | | |
|---|---|---|---|---|
| 2,396,267 A | | 3/1946 | Johnson | |
| 2,481,808 A | | 9/1949 | Barna | |
| 2,959,090 A | | 11/1960 | Davies | |
| 3,141,000 A | | 7/1964 | Turner | |
| 3,482,903 A | | 12/1969 | Thomas et al. | |
| 3,550,386 A | | 12/1970 | Ballinger | |
| 3,565,516 A | * | 2/1971 | Thomas et al. | 359/895 |
| 3,811,460 A | | 5/1974 | Capdevielle et al. | |
| 3,838,434 A | * | 9/1974 | Hughes et al. | 396/27 |
| 3,854,296 A | | 12/1974 | Pogonowski et al. | |
| 3,954,610 A | | 5/1976 | Pogonowski et al. | |
| 4,172,428 A | | 10/1979 | Pariset | |
| 4,502,407 A | | 3/1985 | Stevens | |
| 4,536,789 A | * | 8/1985 | Bains | 348/81 |
| 5,634,888 A | | 6/1997 | Henkin et al. | |
| 5,678,091 A | * | 10/1997 | Daspit | 396/28 |
| 6,008,780 A | | 12/1999 | Clarke et al. | |
| 6,024,145 A | | 2/2000 | Ackles | |
| 6,064,708 A | | 5/2000 | Sakamaki | |

* cited by examiner

*Primary Examiner*—Leonidas Boutsikaris
(74) *Attorney, Agent, or Firm*—James P. Hann; Haynes Beffel & Wolfeld LLP

(57) ABSTRACT

Viewing enhancing apparatus for visibility impaired fluid, such as turbid water or a smoke-filled room, includes a fluid-permeable sidewall and a housing defining a confluence cavity having an axis extending between first and second housing ends. The housing ends are connected by the sidewall. The second housing end is open. The sidewall has a proximal end towards the first housing end and a distal end towards the second housing end. The housing defines a supply cavity surrounding the sidewall and coupleable to a source of viewing fluid, typically clear water when operating in a turbid water environment. The sidewall provides a resistance to flow of the viewing fluid therethrough, the resistance varying according to the position on the sidewall. The viewing fluid passes through the confluence cavity and exits the second housing end. This creates a chosen velocity profile for the viewing fluid exiting the second housing end.

43 Claims, 11 Drawing Sheets

VIEWING ENHANCED APPARATUS FOR VISIBILITY IMPAIRED FLUID

CROSS-REFERENCE TO OTHER APPLICATIONS

This application claims the benefit of provisional patent application No. 60/399,051 filed 26 Jul. 2002.

FEDERALLY SPONSORED RESEARCH OR DEVELOPMENT

None.

BACKGROUND OF THE INVENTION

This invention relates to underwater viewing systems used to allow, for example, a diver or video system to see through muddy or otherwise turbid water. The invention may also find utility for use in other visibility impaired fluids, such as smoke, oils and foaming liquids.

In turbid water a viewing system typically sees nothing but a brown haze of silt, oil or mud. If the turbidity is heavy or concentrated enough, then no illumination can get through either, a condition which the diving community calls black water (BW). BW can be ubiquitous in such places as a sea floor experiencing storm action, the roiling bottom of the Mississippi River, industrial vats or working conduits transferring opaque liquid, opaque slurries, smoke or other visibility impaired gasses, foaming or sudsy liquids, etc. BW can also be caused simply by a diver's movement or a remotely operated vehicle's churning up the silted sea bottom in the normal course of doing work on the bottom. For the diver, his or her only other input is the sense of touch which leaves a lot to be desired when wearing gloves in cold or contaminated water. The quality of work may suffer and production may be slowed. For a system such as a remotely operated vehicle (ROV), which relies solely on a video camera, there is no alternative sense but SONAR which does not have the color sense and the close-up resolution of video.

The simplest method of seeing through turbidity is to use a transparent hydraulic system to displace the turbidity with an illuminated free jet stream of clear water through which, for example, a diver or video system can view the work.

However, one must be careful how the jet is designed because a simple jet stream played into a stationary fluid will break up into turbulence almost immediately. Turbulence is a very efficient mixing regime so the clear water jet would almost immediately be mixed with the surrounding black water, thus destroying the clear column.

BRIEF SUMMARY OF THE INVENTION

A first aspect of the invention is directed to viewing enhancing apparatus for visibility impaired fluid, such as turbid water or smoke in a smoke-filled room. The apparatus includes a fluid-permeable sidewall and a housing defining a confluence cavity having an axis extending between first and second housing ends. The housing ends are connected by the sidewall. The second housing end is open. The sidewall has a proximal end towards the first housing end and a distal end towards the second housing end. The housing defines a supply cavity surrounding the sidewall. The supply cavity is coupleable to a source of viewing fluid, typically clear water when operating in a turbid water environment. The sidewall provides a resistance to flow of the viewing fluid therethrough, the resistance varying according to the position on the sidewall. The viewing fluid enters the supply cavity, passes through the sidewall, passes through the confluence cavity and exits the second housing end. This creates a chosen velocity profile for the viewing fluid exiting the second housing end.

A second aspect of the invention is directed to method for viewing through visibility impaired fluid. A viewing enhancing apparatus is coupled to a source of viewing fluid rate. The apparatus comprises a fluid-permeable sidewall; a housing defining a confluence cavity having an axis extending between first and second housing ends, the housing ends connected by the sidewall, the first housing end being light-transmissible, the second housing end being open; the sidewall having a proximal end towards the first housing end and a distal end towards the second housing end; and the housing defining a supply cavity surrounding the sidewall, the supply cavity coupled to the source of viewing fluid. Viewing fluid, such as clear water, is flowed into the supply cavity, through the sidewall, through the confluence cavity and out through the second housing end. A variable resistance to the flow of the viewing fluid through the sidewall is provided. The resistance varies according to the position on the sidewall to create a chosen velocity profile of the viewing fluid when the viewing fluid has exited the second housing end.

Various features and advantages of the invention will appear from the following description in which the preferred embodiments have been set forth in detail in conjunction with the accompanying drawings.

DETAILED DESCRIPTION OF THE INVENTION

The hydraulic shear stress at the interface between a jet stream and the surrounding stationary fluid seems to cause the onset of turbulence. So, the initial stress which breaks the laminarity can be written as $$\tau T=\mu(\nabla\times v) \quad (1)$$

where $\tau$ is the shear stress, $\mu$ is the absolute viscosity, v is the local jet speed and the vector $\nabla\times v$ is the velocity gradient or shear rate. A term "velocity profile" is used to describe the local velocity of the jet stream across the radius of the jet. The shear rate is the slope of that profile. If you drew a picture of the initial velocity profile at the orifice of a standard laminar jet it would have a generally radially uniform velocity profile; that is it would look like a top hat where the rim represents the stationary ambience outside the interface and the "stove pipe" represents the speed of the jet stream. (S. C. Crow, et.al., *Orderly Structure In Jet Turbulence*, J. Fluid Mech., v. 48, pp. 547–591, 1971.) It is readily apparent that since the slope $\nabla\times v$ at the interface is very large, a top hat profile has an enormously destructive shear at the interface. See FIG. 1 of Crow,et al. The natural viscosity $\mu$ of the intermixing fluids is simply not great enough to damp out the vortices responsible for the mixing.

One aspect of the invention is the recognition that to prevent jet stream mixing, the shear rate $\nabla\times v$ must be reduced in order to give the viscosity $\mu$ a chance to damp out the vortices. This means the jet must have a gradual coaxial increase in speed from the jet periphery all the way inward to the jet centerline just like a laminar flow inside a pipe. The more gradual the profile, the lower the shear rate anywhere on the radius and the farther the jet survives. Pictorially, the velocity profile preferably has an inwardly tapering, generally conical or parabolic profile, that is it should look like a conical "derby hat". That way the slope $\nabla\times v$ is always finite.

There are two strong markets for black water viewing, the diving helmet market and the underwater minicam market. One embodiment is patterned after a prototype to be mounted on a Kirby Morgan type SL27 diving helmet (Diving Systems International, Santa Barbara, Calif.). FIGS. 1–4. A second embodiment notes a hydraulic enclosure around an underwater mini-camera, capable of, for example, a 3300 foot immersion depth, which is to be mounted on an ROV or to be handheld by a diver. See FIG. 10.

Specifications, Diving Helmet Application

Figure 1:
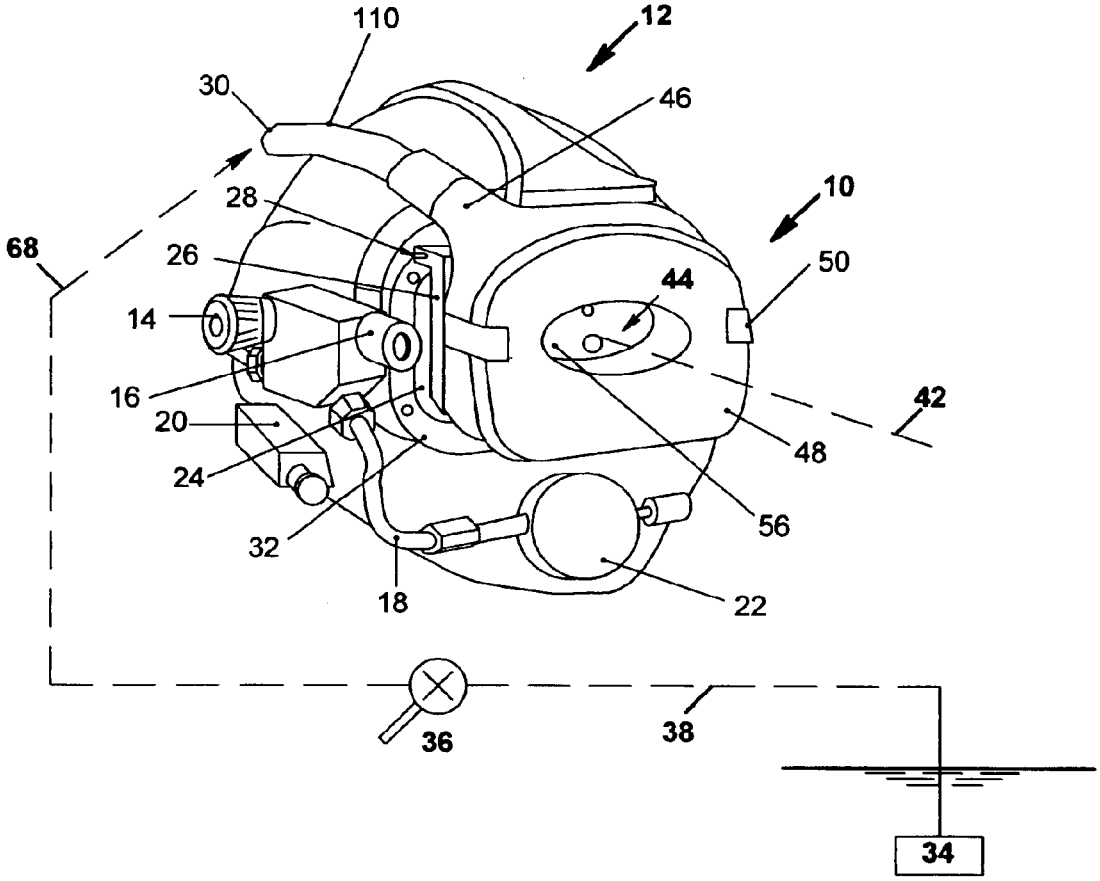
FIG. 1 is an overall view of a clear water viewer made according to the invention mounted to a diving helmet.

See FIG. 1. Beginning with diving helmet 64 and its attendant air supply valves, auxiliary valve 14 and steady flow valve 16 which controls supply line 18. Helmet 12 is held in place by base lock 20. Supply line 18 feeds a demand regulator 22. A viewing glass 24 is fastened to the helmet bolting ring 32.

A clear water viewer 10 is fastened to a welding shield 26 and the shield is hinged and fastened to the brass bolting ring 32 by hinge 28. The viewer 10 can then be flipped up so the diver can better see his or her footing when, for example, on board a tender barge. The viewer is fitted with a 1½" corrugated hose 30 which lays over the back of the diver to a control valve 36 fastened to the diver's waist. The valve 36 is fed by a ¾" hose 38, the hose is taped to the diver's umbilical air hose package (not shown) supplied by the tender barge (not shown). The hose 38 is fastened to a clear water pump and filter 34. The corrugated supply hose 30 is fastened to the viewer 10 at input manifold 46. Orifice 44 of viewer 10 provides a dual-purpose hydraulic output and viewing port while the diver (not shown) looks through a transparent plexiglass backing plate 56 along an optical or viewing centerline 42. Front cover 48 is held in place by Velcro® hook and loop fastener straps 50.

Figure 2:
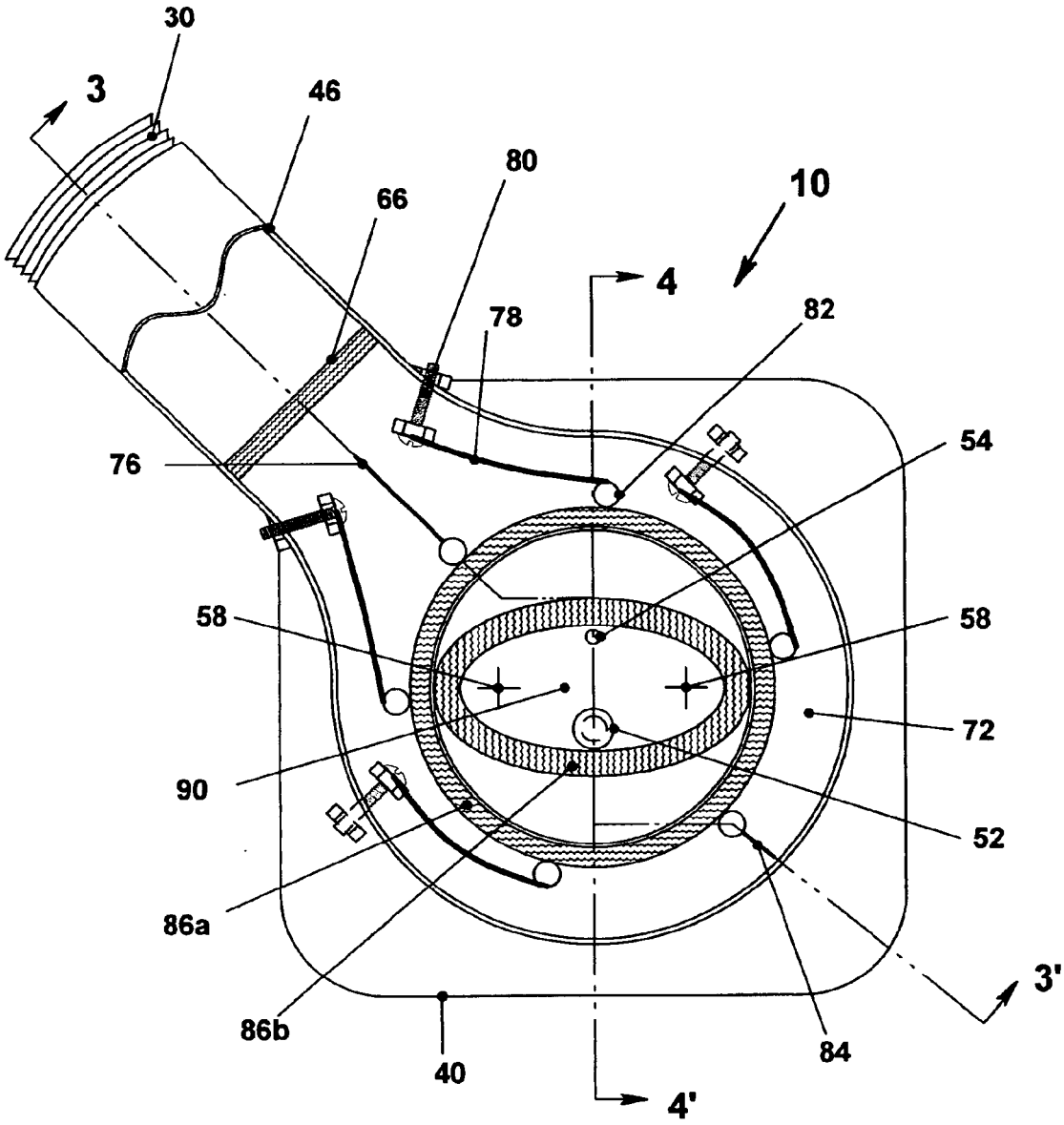
FIG. 2 is a cross sectional view taken along line 2—2 of FIG. 3.
Figure 3:
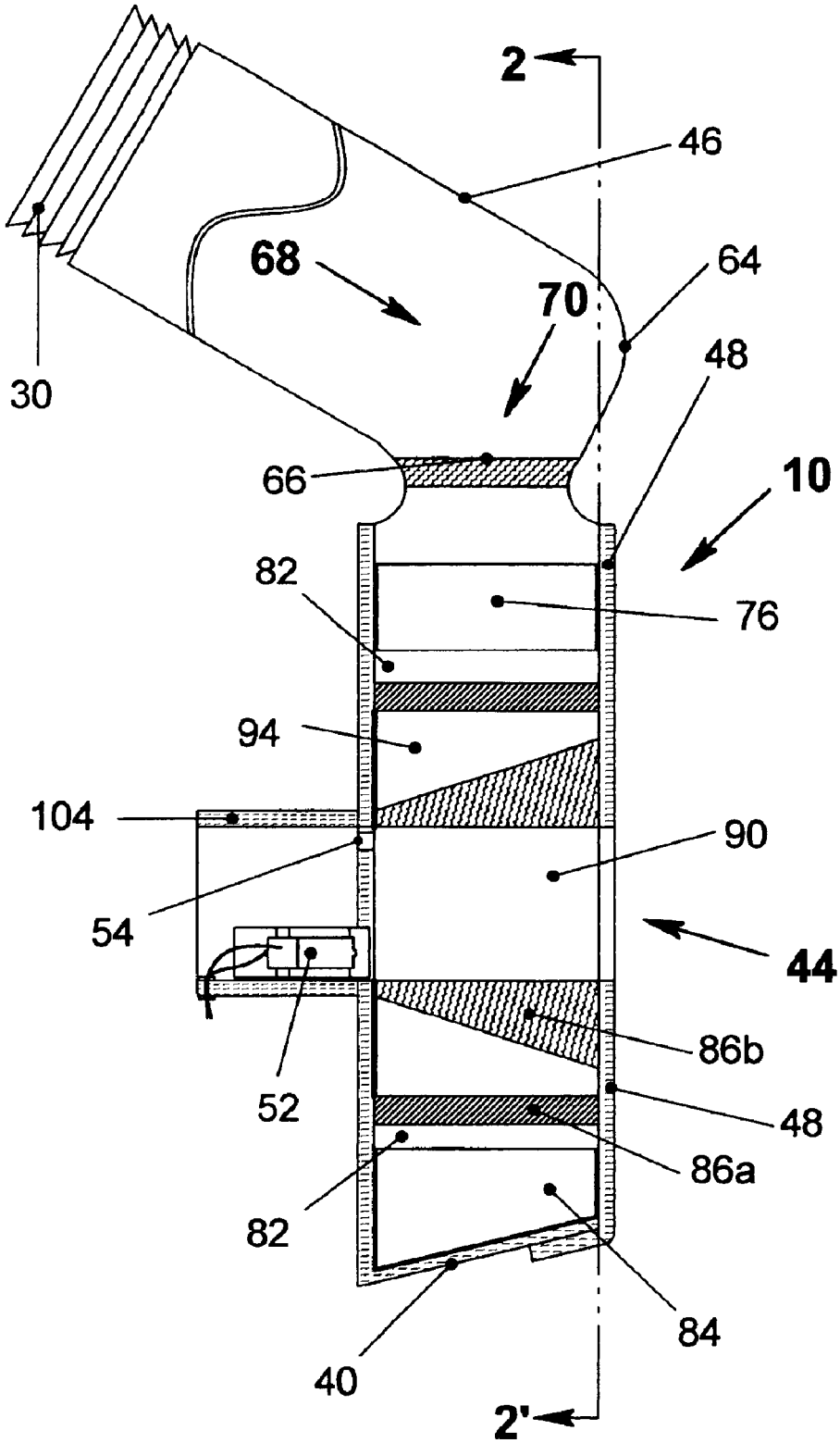
FIG. 3 as a cross sectional view taken along line 3—3 of FIG. 2.

Refer to FIGS. 2 and 3. Water supply hose 30 is attached to input manifold 46, the manifold being an integral part of fiberglass, or equivalent, case 40. Manifold 46 has an elbow. At the intersection of manifold 46 and case 40 is an internal preliminary diffuser 66. Contained inside the case 40 is an annular space 72 formed by the inner surface of said case and the outer surface of ring diffuser 86*a*. The annular space 72 is divided into six semi compartments by a series of scoop vanes 78. Two of the vanes 76 and 84 are stationary and divide the annular space into two halves. The remaining four vanes 78 are adjustable catcher vanes, each pivoting at points 82 and are adjustably positioned by adjusting screws 80. Fitted snuggly inside of, but not attached to, pivot points 82 is the diffuser ring 86*a*. Fit just inside diffuser ring 86*a* is a hollow, truncated, conical diffuser ring 86*b*. Both rings are the same length and are held in place by a slight compression force caused by being wedged between backing plate 108 and front cover 48. Both diffuser rings 86*a* and 86*b* may be, for example, constructed from Scotch Brite®, or equivalent, scouring pads (fine) that can be purchased at most hardware stores. The pads are comprised of a random maze of fibers. Distally, the large diameter of cone 86*b* is located adjacent to the cover plate 48. Glued to the small, proximal, small diameter end of cone 86*b* is a $1/16^{th}$ inch thick flexible washer 106 with an outer diameter no larger than the distal end. The purpose of the ring is to prevent the thin proximal end from collapsing under pressure. The reason there are two diffuser rings is simply the ease of cutting out a taper inside the cylindrical maze while maintaining right cylindrical surfaces on the inner and outer ring surfaces; the outer surface fits snuggly within the pivots 82, the inner surface to facilitate a proper hydrodynamic flow into confluence cavity 90. Cover 48 has a large central hole cut out of the center and is just large enough to expose the entire inner surface of diffuser cone 86*b*. The result is orifice 44, as seen in FIGS. 1, 3, and 4.

Backing plate 108 has a central part cut out and fitted with a viewing glass 56. The viewing glass has two holes cut into it, the upper hole to act as a bubble relief 54, the lower hole is threaded to accept a focused light assembly 52. Viewer 10 is held to a welding shield 26 by Velcro® strips 50 placed between shield 26 and backing plate 108. Shield 26 is fastened to diver's helmet by a hinge 28 which is bolted to a brass helmet ring 32 built into helmet 12; the same ring also permanently holds helmet viewing port 24 in place.

Figure 4:
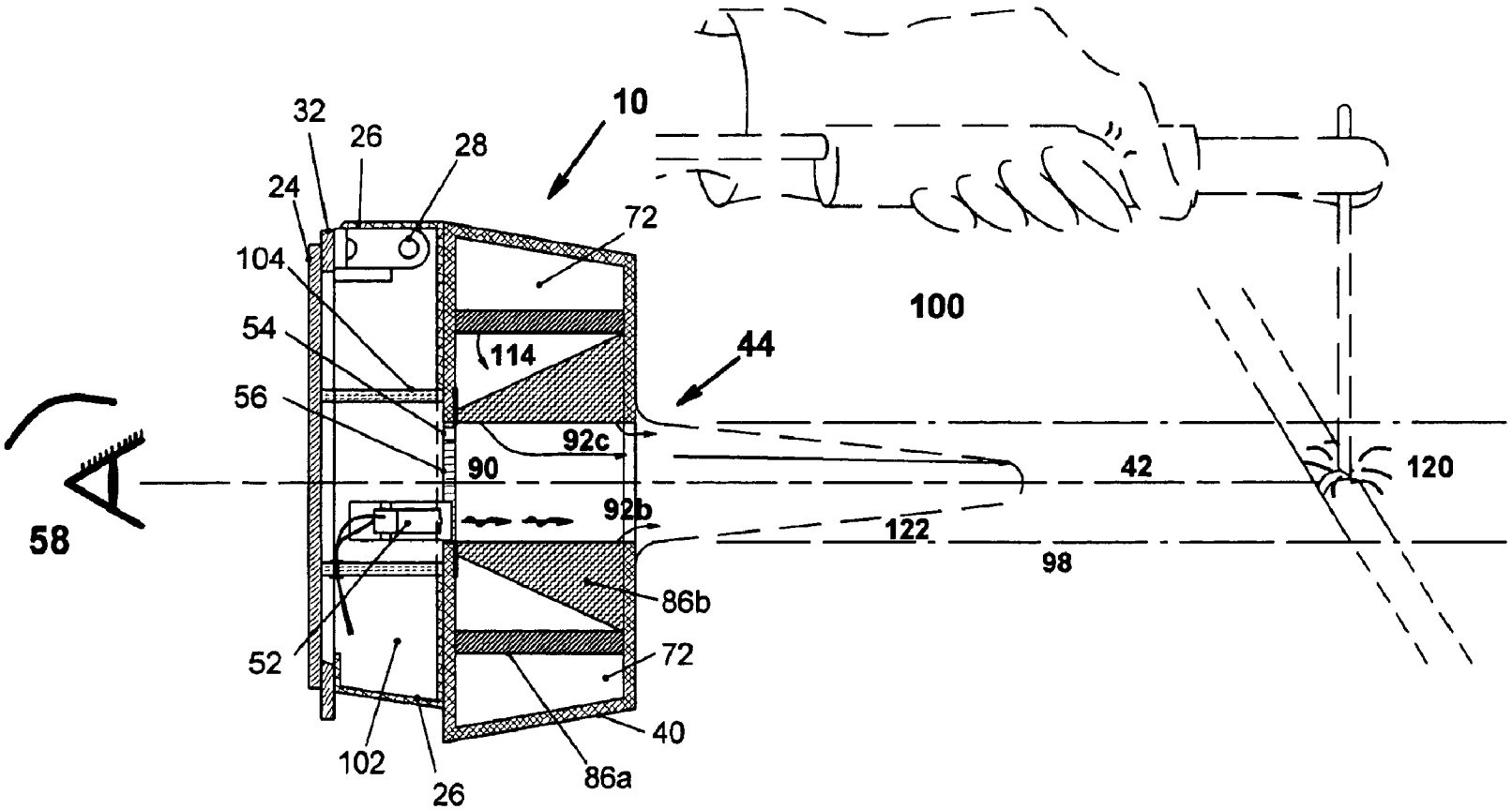
FIG. 4 is a cross sectional view taken along line 4—4 of FIG. 2 and illustrating the creation of a clear water path with a generally conical velocity profile.

Finally, a porous ring 104 is fastened to backing plate 108 so that when welding shield is lowered into working position, shown in FIG. 4, the ring 104 just touches the viewing port 24.

Figure 6:
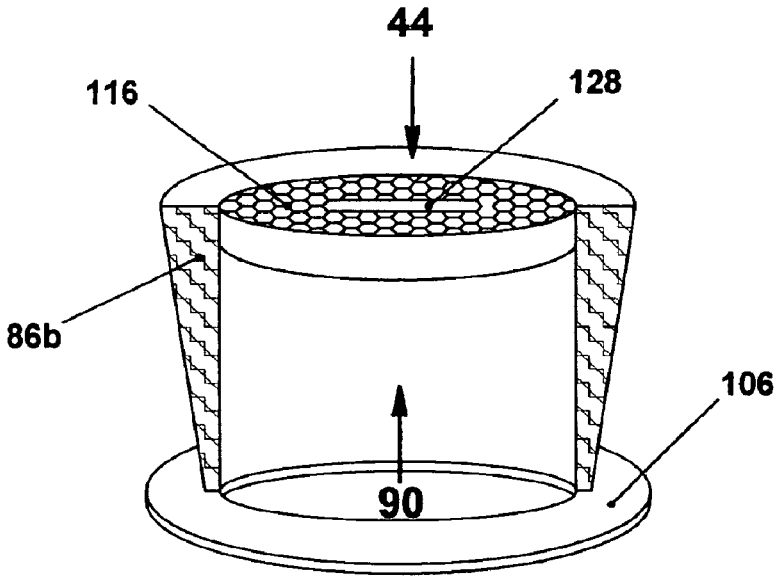
FIG. 6 illustrates the use of flow straightening honeycomb.

Refer to FIG. 6. The truncated cone 86*b* is shown in half view to expose a honeycomb flow straightener 116 fastened in the distal end of confluence cavity 90 (orifice 44). A viewing slot 128 is cut out of the honeycomb for viewing purposes. The use of flow straightener 116 is discussed below.

Figure 7:
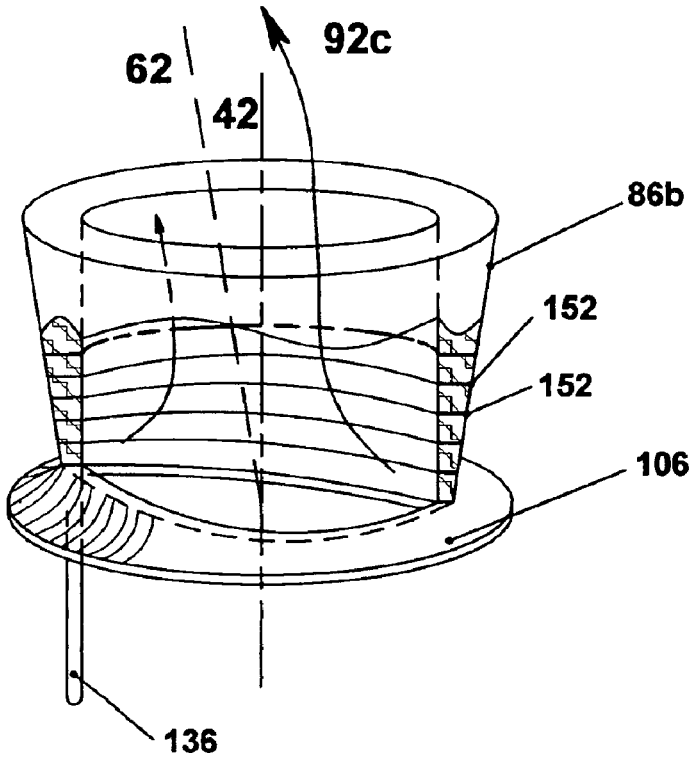
FIG. 7 illustrates biasing the fluid flow to one side by compressing one side of the diffuser ring.

Refer to FIG. 7. The flow 92 is skewed off axis from centerline 42 by compressing one side of the cone 86*b* with a push rod 136. Stabilizer rings 152 are glued inside of cone 86*b* to prevent wall thickening during compression. This increases the fiber density and thus the resistivity of that portion of the cone. The resulting clockwise or azmuthal assymetry causes the high speed flow to overwhelm the diametrically opposite flow. This causes the core 92 to angle away from the centerline. If the honeycomb of FIG. 6 is added, the flow is again made generally parallel to the centerline but now the flow is shifted off center. This causes the flow 92 to 'lean' into the crossflow to reduce side stream errosion.

Figure 8:
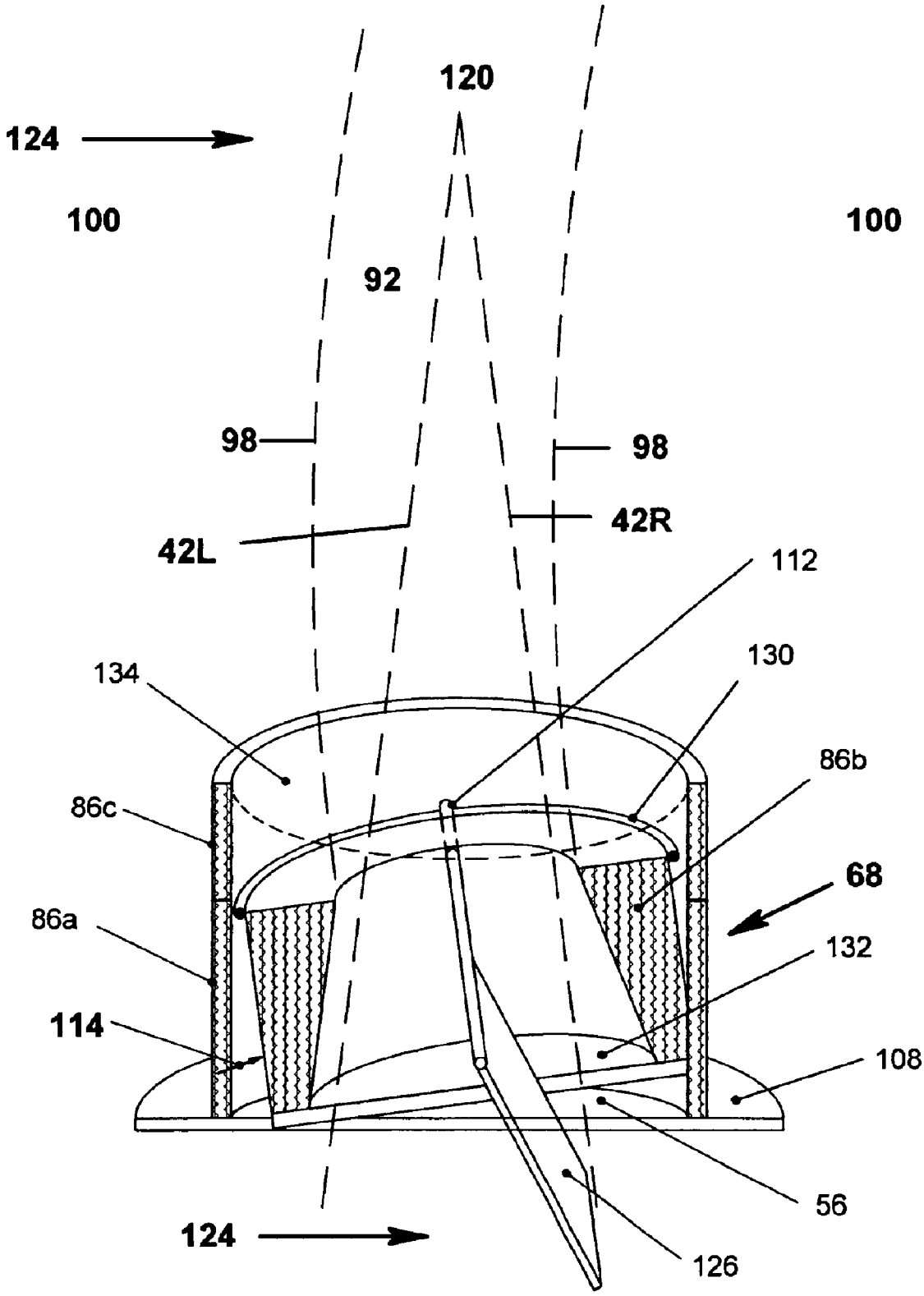
FIG. 8 illustrates alternative method of biasing the fluid flow to the use of a cross current vane.

Refer to FIG. 8. Truncated cone 86*b* is moveable about pivot 112. The cone is caused to pivot by a cross-current vane 126 which is located outside the case 40 in order to sense any cross flow currents. The cone can then "float" around the pivot point. To prevent water inside confluence cavity 90 from passing into the proximal end of the cone, a viewing port 132, typically made of Plexiglas® or other suitable material, is fastened to the proximal end of the cone, thus all the flux inside cavity 90 is forced to leave through orifice 44 at an angle with respect to the centerline 42. The jet stream 92 and its attendant off-center hydraulic centerline 62 is driven back in a curve due to the cross-flow 124 pushing the jet sideways as the jet progresses outward to meet the optical centerline 42. This allows the diver's eye 58 to see farther to the target 120—like throwing a ball upward as well as horizontally to gain a greater distance. Diffuser 86*c* bleeds a small amount of clear water into rotating space 134 inside orifice 44 to keep out the turbidity 100.

Figure 9:
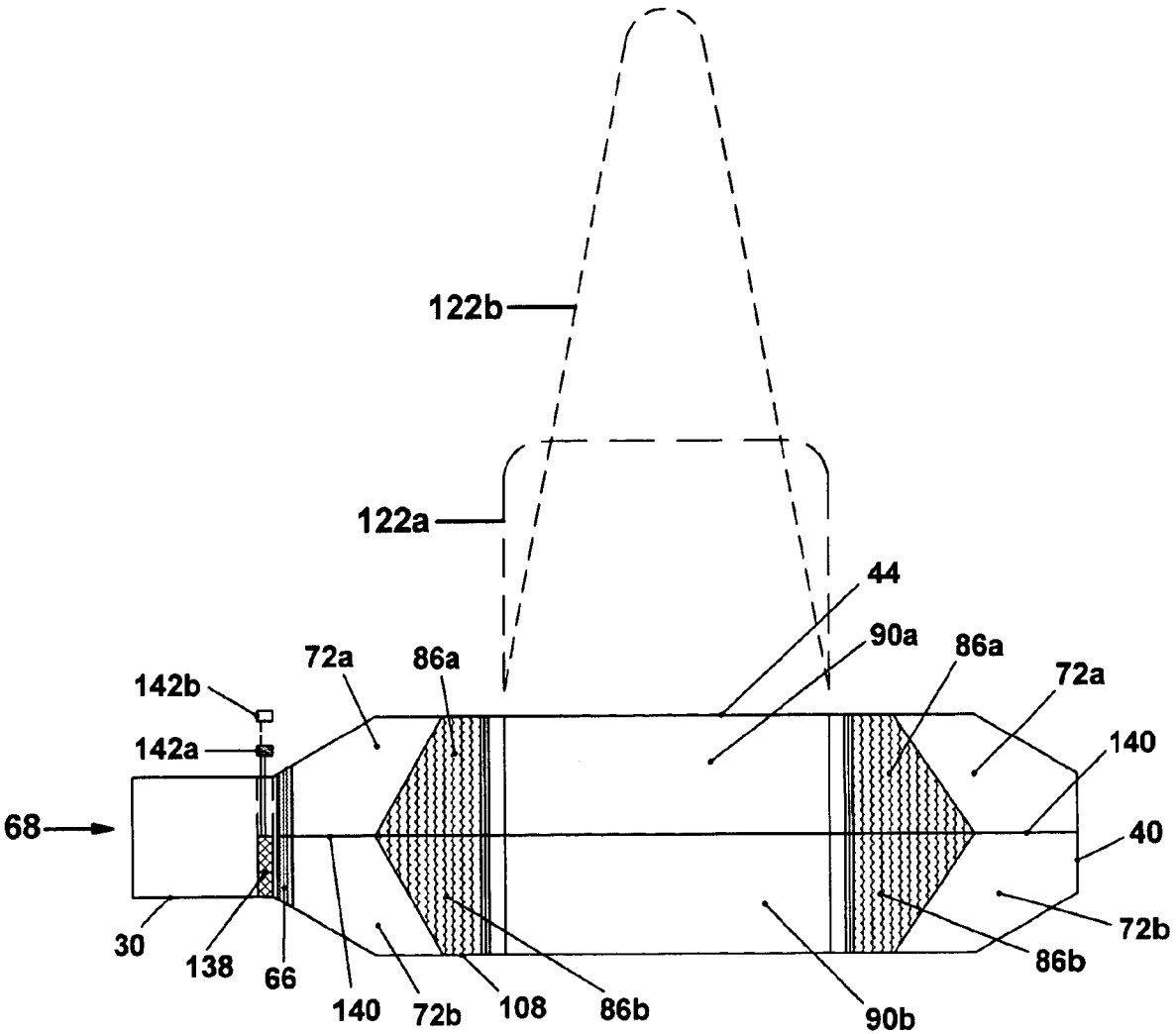
FIG. 9 illustrates an alternative embodiment comprising two different variable resistance diffuser rings.

Refer to FIG. 9. Flow profile 122 can be changed by the diver on site by simply shifting lever 142 in or out. The "in" position closes a gate valve 138 to annular cavity 72*b*. This causes all the flow 68 to enter annular area 72*a*. The flow then enters truncated cone 86A which then fills confluence cavity 90*a*. The flow distribution is designed to cause the velocity profile 122*a* to be radially uniform across the orifice 44. This could be used for short viewing distances with a wide view. When lever 142 is pulled out the gate valve 138 closes off 72*a* and opens 72*b*. This floods confluence cavity 90*b*. Cavities 90*a* and 90*b* are mounted tandemly and are separated by a non-porous membrane 140, which has a hole in the center to couple 90*a* with 90*b*. The resulting velocity profile is more derby hat (profile 122*b*) for long distance viewing. If desired, truncated cone 86*a* could be configured to create a turbulent stream. This would allow the user to, for example, initially place gate valve 138 in the solid line position and use the turbulent jet to excavate the muddy site; the user would then move gate valve 138 to the dashed line position to permit viewing of the excavated area. This excavate-then-view system may eliminate the need for a separate hose of pressurized water for excavation purposes.

If a top hat velocity profile is ever used, as in severe crossflow where a slow peripheral boundary layer 92*b* may be blown away, then to prevent turbulent break-up, the diver could inject a 1% solution of a pseudoplastic into the supply stream 68 of input line 30. A Pseudoplastic changes its viscosity $\mu$ according to the shear rate $\nabla \times v$; Newtonian fluids such as water do not. So a non-Newtonian use of a stir-thinning pseudoplastic such as the Bingham plastic Carbopol, manufactured by Goodyear, could be used as a very effective anti-turbulent stabilizer even with a top hat profile. With a 1% pseudoplastic injected in a jet stream issuing into a Newtonian environment., a non mixing, laminar jet stream has been measured out, to 30 to 50 orifice diameters. The diver would need a supply tank somewhere on his suit or it could be supplied at the clear water pump 34.

The problem with injectants of this type is that they contaminate the environment, and there is a limited supply of injectant. Viscous Newtonians such as glycerine or honey could also be used but the injection point would have to be close to the orifice otherwise the high viscosity dramatically slows pumping speeds.

The elliptical orifices shown are one example of how they can be shaped. If the viewer 10 is mounted on an ROV inside a conduit and the orifice 44 were a rectangular slit with a width-to-height aspect ratio of 10 or 20, then a video system could scan in the width X direction (curvature of the conduit) while the viewer 10 was physically transported by the ROV in the height Y direction (along the conduit length), much like a side scan SONAR records the sea bottom. A monitor could then record the entire surface of the conduit in a minimum of time. If time were very short, several viewers could ring the ROV so that one pass records the entire circumference and length of the conduit in optical acuity and in color.

If a crack is found and one was interested if it was leaking, an ink injection system could be placed at the edge of the orifice, right in the image, and opaque ink around the crack would indicate if fluid was leaking in or out by the character of the ink flow. This would give an indication of the condition outside the conduit as well. The shape our slant of the crack would give the survey engineer an idea of the type of stress the conduit is undergoing. This could be done even though the conduit is full of working fluid.

Another use of a shaped orifice would be to mount the viewer on a shovel or broom, or scraper so the archaeologist can view the dig in real time. This would provide an intelligent, real time excavation, important when working in a time dependent weather window and when one is digging around very fragile ruins or electrical cables. Also, one could attach a video viewer to his or her wrist for a look-and-feel exploration in archaeological research or search and rescue operations.

In a circular orifice where the curvature K of the periphery is uniform all around, the flow 96 enters the confluence cavity 90 in a radial direction and then turns axially as an azmuthally uniform or symmetrical jet stream 92. But in an elliptical orifice, the curvature K is greater at the major axis (elliptical end) than at the minor axis or mid section, FIG. 11.

Figure 11A:
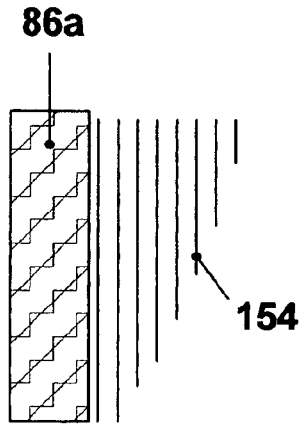
FIGS. 11*a* and 11*b* are exploded cross sectional views, respectively taken along lines 11*a*—11*a* and 11*b*—11*b* of FIG. 11, illustrating the different numbers of layers of flow resistance cloth at different circumferential locations.
Figure 11B:
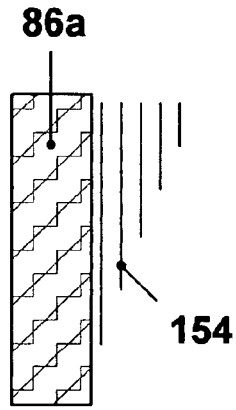

The radius of curvature r=1/K is therefore smaller in that region and even though the control supply area, 1*c*, of the fiber ring 86*a* may be the same (in this drawing) the subtended area rc is smaller at the elliptical ends than in the center. This can cause the end flow to be more intense than the mid-ellipse flow and may cause a top hat profile at the elliptical ends. To prevent this the elliptical ends (a) of fiber matrix ring 86*a* may be masked with more layers of resistance cloth 154 than at the center of the ellipse (b) as shown in FIGS. 11*a* and 11*b* respectively. Instead of multiple layers of uniform resistance cloth, a doppled paint or glue pattern to achieve the proper resistance profile. The fiber backing 86 averages out the dot irregularities. One can also use a wound opacity tape, see FIG. 11*c*, closely wound at the high impedance (distal) end, and open wound at the proximal end. Other bands of flow inhibiting or flow preventing material may also be used.

Specifications, Video Application

Figure 10:
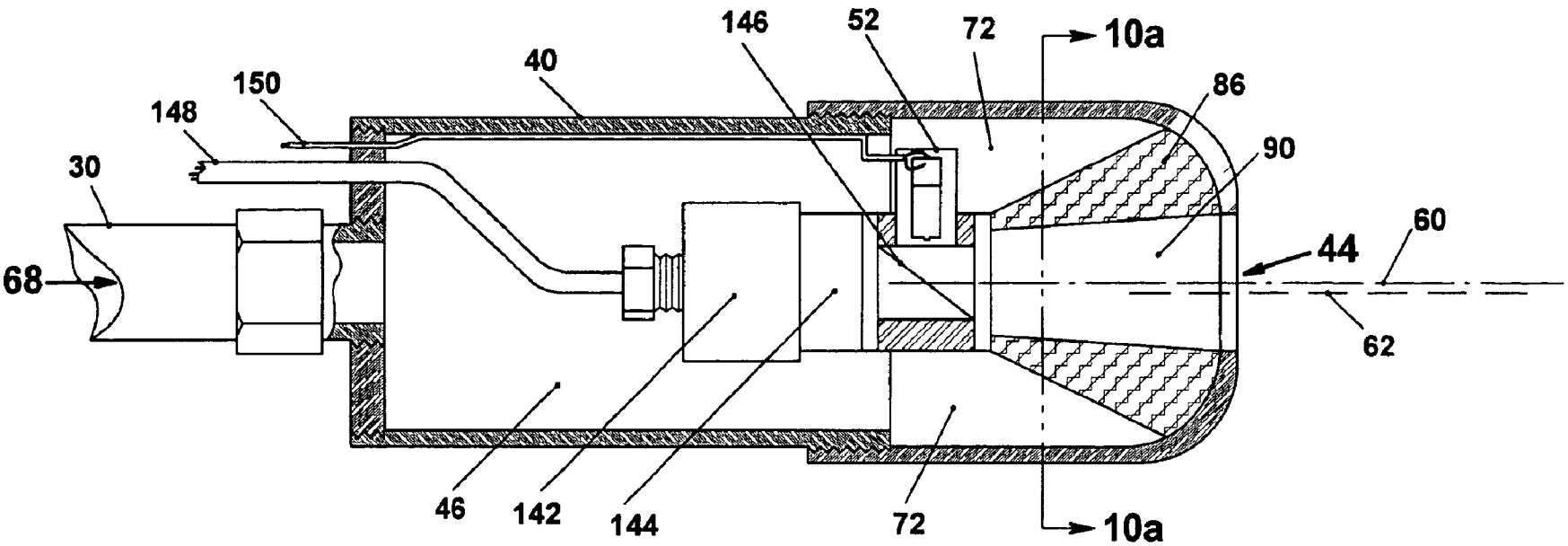
FIG. 10 illustrates an alternative embodiment used with a video application.
Figure 10A:
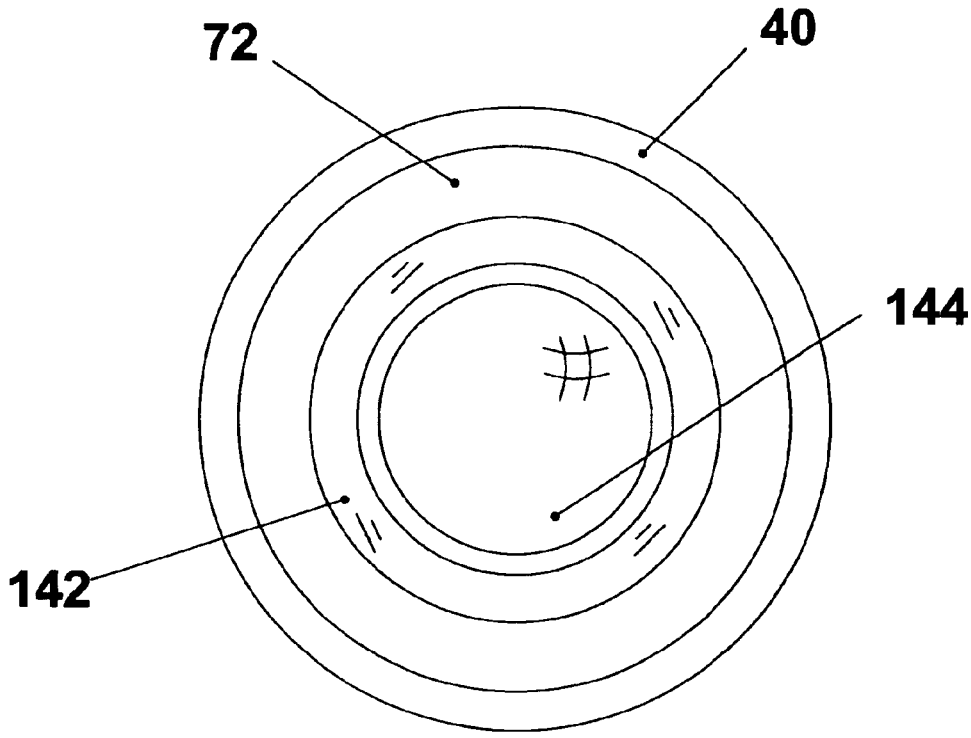
FIG. 10*a* is a cross sectional view taken along line 10*a*—10*a*.

Refer to FIG. 10. A video application is shown as a black water video viewer 10. Inlet hose 30 is attached to the proximal end of case 40. At the distal end of case 40 is a truncated cone 86 having a hollow center. The proximal side of the center is blocked off by a camera system, the distal end is open and is orifice 44. The interior is confluence cavity 90. The camera system comprises a video camera 142, such as an Outland Tech Mini, model 400 color, or equivalent (Outland Technology, Slidell, La.) with lens 144. Attached to the camera is a video cable 148 for power-in and signal-out. The camera lens 144 is focused on target 120 (see FIG. 4) along hydraulic centerline 62. The hydraulic centerline is also the optical centerline 42. An illumination source 52 is focused along the same centerlines 42 and 62. A split beam mirror encased in a glass cube 146, such as the Edmund 25 millimeter, non polarizing cube, allows a light source 52 to be located perpendicular and off the optical axis 42. The cube is protected from rough handling by a disk, typically made of Lexan® polycarbonate or other suitable material, at the proximal end of confluence cavity 90. The incoming flow 68 through pipe 30 enters axially so the spider system 78 is not needed. FIG. 10*a* shows a uniform azmuthal geometry used to supply video diffuser cone 86.

Operation. Diver Application

See FIG. 1. Clear water 68 is pumped from a clear water source by pump 34. The flow is controlled by a valve at the diver's waist 36 because there are simply too many valves already at the typical control site. Also, if there is any air in line 38 the line might buck when first turned on and that motion should not be transferred to the diver's helmet.

See FIGS. 2 and 3. Flow 68 then enters manifold 46. Because the line approaches the helmet from behind the diver's back, flow 68 enters 46 at an angle. This is not recommended because it puts too much dynamic pressure on the forward (distal) end of viewer 10. So an elbow 64 deflects flow 68 back toward the center of the manifold as back flow 70. The average flow between 68 and 70 is mixed and partially smoothed by a preliminary diffuser 66 so that the flow enters case 40 as perpendicular flow 74. Flow 74 is then distributed azimuthally around annular spaces 72. Scoop vanes 78 can be adjusted by screws 80 so that the distribution is equal all around. As the flow 74 enters outer diffuser ring 86*a*, the pressure of the diffuser on the screws 82 prevent any leak-by from one semi-compartment or quadrant to another; the quadrants being created by the space between adjacent scoop vanes 78. Thus, each scoop vane has full control over the portion of the flow 74 entering its quadrant.

See FIGS. 2, 3, and 4. There are several reasons for using a fiber diffuser ring 86. Beside being a very low pressure device (1–2 psi) and inexpensive to manufacture, a nested fiber ring set 86*a* and 86*b* can eliminate micro vortices by the simple damping action of viscous water passing through a fine fibril maze. (Dryden, et.al., Growth And Delay Of Vortex Motion, pp. 212–218, chapter 3.4, *Hydrodynamics*, Dover Publications, 1956.) In a laminar, non mixing jet it is essential that as little vortical flow exists in the output in order to eliminate unwanted turbulence downstream.

Another use of the fiber ring is that the pre flow 74 does not have to enter perpendicularly the outer surfaces of rings 86*a* and 86*b* in order for an effusing flow 114 and 96 respectively to leave perpendicularly. This is described in Irmay's Law of Refractive Flow through a Porous Medium Interface between two adjacent porous materials. (Bear, Discontinuity In Permeability, pp. 263–269, chapter 7.1.10, *Dynamics Of Fluids A Porous Medium*, Dover Publications, 1972.) So, all around the inside of diffuser 86*b*, the effusion 96 is flowing radially and non-rotationally inward toward hydrodynamic centerline 62 centrally located inside confluence cavity 90.

Figure 5:
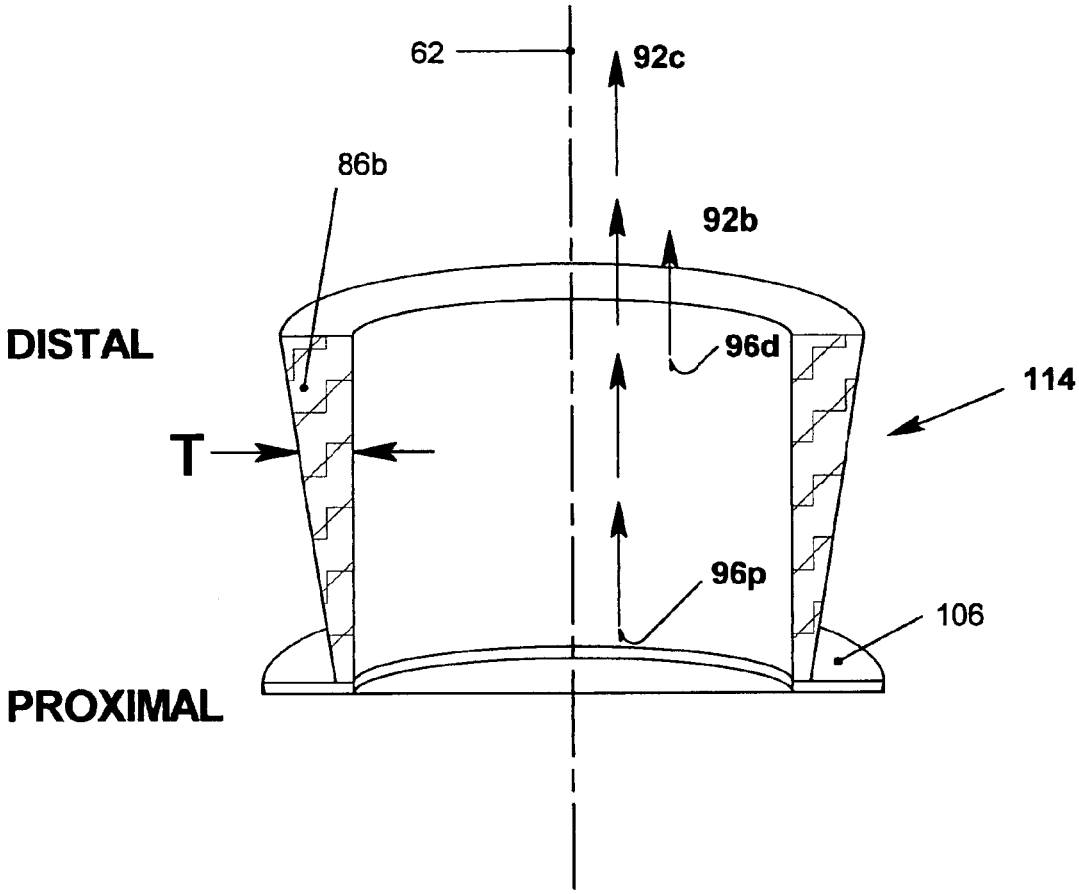
FIG. 5 illustrates the flow of water through the variable resistance diffuser ring.

See FIG. 5. Because of the viscosity of water, additional vortical damping can occur as flow 96 converges toward the center as long as the critical Reynolds Number is not exceeded, as mentioned in the next paragraph. This convergence phenomenon can be called Vortical Pinch Effect.

The outer shape of diffuser 86*b* is conical in shape in order to cause the proximal flow, as seen in FIG. 5, to effuse faster than the distal flow. Since the flow 96 into the confluence cavity 90 is perpendicular to the surface of the pot, the local velocity can be written as $$V_{96}=\Delta p/Zv \tag{2}$$

where, $$Z=RT \tag{3}$$

Here, $V_{96}$ is the radially inward perpendicular flow, $\Delta p$ is the local pressure differential between intermediate cavity 94 and confluence cavity 90, R the resistivity of the porous material of 86*b*, and T the local thickness and $\upsilon$ is the kinetic viscosity. Flow 96 effuses radially inward toward the centerline 62 and then, because it has nowhere else to go, turns along the centerline to become axial flow 92. Since the streamlines do not cross, the high speed proximal flow 96*p* turns to become high speed axial core 92*c*. The low speed distal flow 96*d* turns to become low speed axial shroud or boundary layer 92*b* which surrounds the high speed core 92*c* and protects 92*c* from the surrounding turbidity 100. The shear rate $\nabla\times v$ from (1) should be continuous along the radius of the jet stream so that a derby hat profile is maintained.

For an orifice Reynolds Number $4Q/\pi D\upsilon$ greater than $10^4$ the Reynolds stresses might become significant and rotation of the core might occur. Here, Q is the pumping speed, D is the orifice diameter and. To help prevent rotation a flow straightener such as honeycomb 116 might be used, see FIG. 6. But for relatively slow orifice flow speeds, e.g. 20 gallons per minute pumped through a 4 square inch orifice, a simple open orifice such as shown in FIGS. 1–5 is sufficient.

Computations involving empirical flow parameters in (2) shows similar derby hat profile as in FIG. 4 and was also found in shallow ocean water tests runs. There were two types of runs. The first involved ink injections into hose 30 which would exit orifice 44 causing velocity profile 122 to be very apparent. The second type of runs included lighted through-the-core visual observations of an object in black water, just as a diver would see it. A very strong core was observed due to the linear taper described in (2) aided by the Pinch Effect.

Figure 11C:
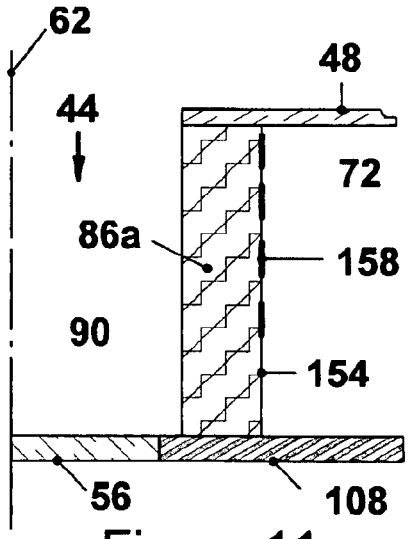
FIG. 11*c* is a view similar to FIG. 11*a* but illustrating the creation of a variable resistance to flow by placing bands of flow inhibiting or flow preventing material on the diffuser ring.
Figure 11:
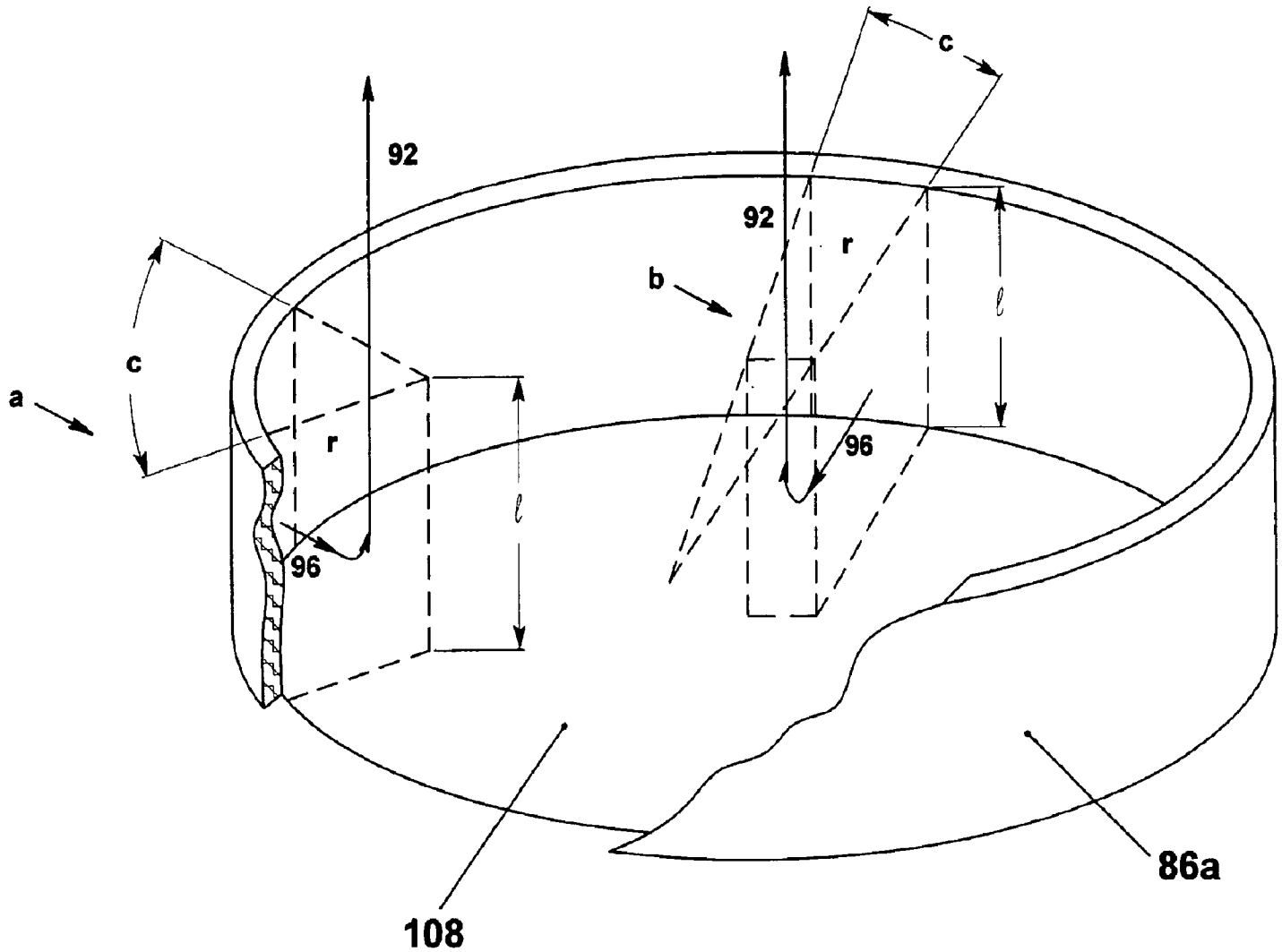
FIG. 11 illustrates the effects of the change in the radius of curvature of a variable resistance diffuser ring having an elliptical cross sectional shape.

So much of the viewer's success depends on the cone 86*b*. But a cone is not necessary. It can be replaced with layers of strategically placed resistance cloth 154 which, for example, can be wrapped around cylinder 86*a*, thus eliminating the necessity of cone 86*b* altogether. This is discussed below with reference to FIGS. 11–11*b*. It is simply another alternative to facilitate an impedance gradient $\nabla Z$ to flow 96. In this case confluence cavity 90 and orifice 44 would be formed by the inner surface of 86*a*, cover 48, and backing plate 108. FIG. 11*c* shows a modified form of impedance gradient $\nabla Z$: a layer of resistance cloth 154 is secured to the outer surface of ring 86*a*. A series of spaced apart flow barrier tapes 158 are secured to cover cloth 154; adjusting the distance between adjacent tapes increases or decreases the flow impedance through ring 86*a*. Flow barrier tapes 158 may completely prevent fluid flow through the tapes or merely retard fluid flow through the tapes.

The orifice may be elliptically shaped for two reasons: 1) the major horizontal axis accommodates the distance between the viewer's eyes, and 2) the orifice height minor axis reduces the cross sectional area of the orifice.

The elliptical orifice is like that of an aerodynamic strut in a wind—the drag and thus the deflection of the jet column 92 is reduced, since the head-on cross section of the jet with an oncoming horizontal cross flow 124 is reduced. Also, a small minor axis increases the effective core speed $v_{92}$. thus stabilizing the flow which keeps the viscosity from diffusing the jet stream too rapidly. There seems to be an optimum core speed-to-viscosity ratio that maximizes the distance the core travels before dissolution takes place. Most divers are interested in core distances of 3 feet with a minimum major diameter of 3 to 4 inches. A reduced orifice area also decreases the recovery time when a momentary cross flow deflection takes place.

Operation, Video Application

Clear water 68 enters input hose 30 to supply intermediate manifold 46. The annular space 72 just inside body 40 and the outside surface of a camera system forms the supply route for internal flow 114 to enter the porous cone 86. See FIG. 5. As in the helmet system, cone 86 creates a non-mixing laminar core 92*c* with a low speed boundary layer 92*b*; see Operation, Diving.

If inlet pipe 30 must be connected to the side of viewer case (not shown) then the pre-flow scoop vane system shown in FIG. 2 would have to be used in order to control the azimuthal supply to the cone 86.

All modifications shown in FIGS. 6–9 are applicable in the video system as well with one modification. If the video system were to be connected to the proximal end of the rotating cone 86*b*, such that the system would be attached to the back of rotatable surface 132, then the camera could be rotated with respect to the body 40 for scanning the inside surfaces of a conduit for instance. This is not shown, but is assumed to be understood. In this case the cross current vane 126 would be replaced by a remotely operated controller for selective viewing left and right.

Other modification and variation can be made to the disclosed embodiments without departing from the subject of the invention as defined in following claims. For example, the viewing fluid is typical clear water when working in turbid water; or other fluids, such as clean air, may be used when operating in other environments, such as a smoke-filled room.

Any and all patents, patent applications and printed publications referred to above are incorporated by reference.

What is claimed is:

1. Viewing enhancing apparatus for visibility impaired fluid comprising:

a fluid-permeable sidewall;

a housing defining a confluence cavity having an axis extending between first and second housing ends, the housing ends connected by the sidewall, the second housing end being open;

the sidewall having a proximal end towards the first housing end and a distal end towards the second housing end;

the housing defining a supply cavity surrounding the sidewall, the supply cavity coupleable to a source of viewing fluid;

the sidewall providing a resistance to flow of the viewing fluid therethrough, the resistance varying according to the position on the sidewall; and whereby a chosen velocity profile of the viewing fluid, which enters the supply cavity, passes through the sidewall, passes through the confluence cavity and exits the second housing end, is created when viewing fluid has exited the second housing end.

2. The apparatus according to claim 1 wherein the first housing end has a bubble-relief hole.

3. The apparatus according to claim 1 wherein the sidewall has an elliptical cross-sectional shape.

4. The apparatus according to claim 1 wherein the resistance varies according to the position along the axis.

5. The apparatus according to claim 3 wherein the resistance varies according to the position along the axis and the circumferential position around the axis.

6. The apparatus according to claim 1 wherein the first housing end is light-transmissible, and further comprising a light source adjacent to the first housing end.

7. The apparatus according to claim 1 wherein the supply cavity comprises flow-directing elements.

8. The apparatus according to claim 1, wherein the supply cavity comprises adjustable position flow directing elements so to enable adjustment of the flow of the viewing fluid to different regions of the sidewall.

9. The apparatus according to claim 1 wherein the supply cavity comprises means for balancing flow to different regions of the sidewall.

10. The apparatus according to claim 1 wherein the resistance varies from a lower resistance at the proximal end to a higher resistance at the distal end.

11. The apparatus according to claim 10 wherein the varying resistance creates an inwardly tapering velocity profile for the viewing fluid when the viewing fluid has exited the second housing end.

12. The apparatus according to claim 11 wherein the varying resistance creates a generally conical velocity profile.

13. The apparatus according to claim 1 wherein the resistance varies continuously between the proximal and distal ends.

14. The apparatus according to claim 1 wherein the resistance varies from a higher resistance at the proximal end to a lower resistance at the distal end.

15. The apparatus according to claim 1 wherein the resistance varies uniformly between the proximal and distal ends, the varying resistance creating a generally radially symmetrical velocity profile for the viewing fluid when the viewing fluid has exited the second housing end.

16. The apparatus according to claim 1 wherein the sidewall has a first resistance profile towards the proximal and a second resistance profile towards the distal end.

17. The apparatus according to claim 16 further comprising means for selectively directing viewing fluid to a chosen one of the first and second resistance profiles.

18. The apparatus according to claim 16 wherein the first resistance profile increases from the first housing end towards the second housing end.

19. The apparatus according to claim 16 wherein the second resistance profile decreases from the first housing end towards the second housing end.

20. The apparatus according to claim 1 wherein the sidewall comprises flow-diffusing material.

21. The apparatus according to claim 20 wherein the flow-diffusing material comprises flow-restricting material.

22. The apparatus according to claim 1 further comprising diving helmet mounting hardware adapted to mount the housing to a diving helmet.

23. The apparatus according to claim 22 wherein the mounting hardware comprises a hinge to permit the housing to be moved between a first position, covering a viewing port of the diving helmet, and a second position, spaced-apart from the viewing port of the diving helmet.

24. The apparatus according to claim 1 further comprising means for changing the direction of the flow axis relative to the housing.

25. The apparatus according to claim 1 further comprising means for modifying the resistance to fluid flow of the sidewall according to the circumferential position around the axis.

26. The apparatus according to claim 25 further comprising a flow straightener towards or at the second housing end.

27. The apparatus according to claim 1 further comprising a flow straightener towards or at the second housing end.

28. Viewing enhancing apparatus for visibility impaired fluid comprising:

a source of viewing fluid;

a fluid-permeable sidewall;

a housing defining a confluence cavity having an axis extending between first and second housing ends, the housing ends connected by the sidewall, the first housing end being light-transmissible, the second housing being open;

the sidewall having a proximal end towards the first housing end and a distal end towards the second housing end;

the housing defining a supply cavity surrounding the sidewall, the supply cavity coupleable to the source of viewing fluid;

the sidewall providing a resistance to flow of the viewing fluid therethrough, the resistance varying according to the position on the sidewall; and whereby a chosen velocity profile of the viewing fluid, which enters the supply cavity, passes through the sidewall, passes through the confluence cavity and exits the second housing end, is created when viewing fluid has exited the second housing end.

29. The apparatus according to claim 28 wherein the viewing fluid comprises water.

30. The apparatus according to claim 28 wherein the viewing fluid comprises water and a viscosity-increasing agent.

31. The apparatus according to claim 30 wherein the viscosity-increasing agent comprises a pseudoplastic.

32. Viewing enhancing apparatus for visibility impaired water comprising:

a housing defining a confluence cavity having an axis extending between first and second housing ends, the housing ends connected by a water-permeable, flow-diffusing sidewall, the first housing end being light-transmissible, the second housing and being open;

the sidewall having a proximal end towards the first housing end and a distal end towards the second housing end;

the housing defining a supply cavity surrounding the sidewall, the supply cavity coupleable to a source of viewing fluid;

the supply cavity comprising user-operated means for selectively adjusting fluid flow through different regions of the sidewall;

the sidewall comprising flow-diffusing material; and the sidewall providing a resistance to flow of the viewing fluid therethrough, the resistance varying generally continuously from a lower resistance at the proximal end to a higher resistance at the distal end to create an inwardly tapering velocity profile for the viewing fluid when the viewing fluid has exited the second housing end.

33. The apparatus according to claim 32 wherein the flow adjusting means comprises adjustable position flow directing elements so to enable adjustment of the flow of the viewing fluid to different regions of the sidewall.

34. The apparatus according to claim 32 wherein the flow adjusting means comprises means for selectively compressing a portion of the sidewall.

35. A method for viewing through visibility impaired fluid comprising:

coupling a viewing enhancing apparatus to a source of viewing fluid, the apparatus comprising:

a fluid-permeable sidewall;

a housing defining a confluence cavity having an axis extending between first and second housing ends, the housing ends connected by the sidewall, the first housing end being light-transmissible, the second housing end being open;

the sidewall having a proximal end towards the first housing end and a distal end towards the second housing end; and the housing defining a supply cavity surrounding the sidewall, the supply cavity coupled to the source of viewing fluid;

flowing viewing fluid into the supply cavity, through the sidewall, through the confluence cavity and out through the second housing end; and providing a variable resistance to the flow of the viewing fluid through the sidewall, the resistance varying according to the position on the sidewall to create a chosen velocity profile of the viewing fluid when the viewing fluid has exited the second housing end.

36. The method according to claim 35 wherein the coupling step is carried out with the viewing fluid comprising water.

37. The method according to claim 35 wherein the coupling step is carried out using water plus a viscosity-enhancing agent as the viewing fluid.

38. The method according to claim 35 wherein the variable resistance providing means step is carried out so that the resistance varies generally uniformly from a lower resistance at the proximal end to a higher resistance at the distal end to create a generally conical velocity profile for the viewing fluid when the viewing fluid has exited the second housing end.

39. The method according to claim 35 further comprising adjusting the flow of viewing fluid to different regions of the sidewall.

40. The method according to claim 35 further comprising selectively adjusting the flow of the viewing fluid through the sidewall according to the circumferential position around the axis.

41. The method according to claim 40 wherein the selectively adjusting step comprises selectively adjusting the position of at least one flow-directing element associated with the supply cavity.

42. The method according to claim 40 wherein the selectively adjusting step comprises selectively compressing a portion of the sidewall.

43. A method for viewing through visibility impaired water comprising:

coupling a viewing enhancing apparatus to a source of viewing fluid, the apparatus comprising:

a fluid-permeable sidewall;

a housing defining a confluence cavity having an axis extending between first and second housing ends, the housing ends connected by the sidewall, the first housing end being light-transmissible, the second housing end being open;

the sidewall having a proximal end towards the first housing end and a distal end towards the second housing end; and the housing defining a supply cavity surrounding the sidewall, the supply cavity coupled to the source of viewing fluid;

flowing viewing fluid into the supply cavity, through the sidewall, through the confluence cavity and out through the second housing end;

providing a variable resistance to the flow of the viewing fluid through the sidewall, the resistance varying according to the position on the sidewall to create a chosen velocity profile of the viewing fluid when the viewing fluid has exited the second housing end;

the variable resistance providing means step carried out so that the resistance varies generally uniformly from a lower resistance at the proximal end to a higher resistance at the distal end to create a generally conical velocity profile for the viewing fluid when the viewing fluid has exited the second housing end; and selectively adjusting the flow of the viewing fluid through the sidewall according to the circumferential position around the axis to radially shift the generally conical velocity profile.

* * * * *

UNITED STATES PATENT AND TRADEMARK OFFICE

CERTIFICATE OF CORRECTION

PATENT NO. : 6,900,954 B2
DATED : May 31, 2005
INVENTOR(S) : James B. Tichy

It is certified that error appears in the above-identified patent and that said Letters Patent is hereby corrected as shown below:

Column 3,
Line 17, should read:
-- $T = \mu( \nabla \times v )$ --.

Signed and Sealed this

Thirtieth Day of August, 2005

JON W. DUDAS
*Director of the United States Patent and Trademark Office*